US005683509A

United States Patent [19]

Sollinger et al.

[11] Patent Number: 5,683,509

[45] Date of Patent: Nov. 4, 1997

[54] APPARATUS FOR APPLYING A LIQUID OR PASTY MEDIUM ONTO A MOVING MATERIAL WEB

[75] Inventors: Hans-Peter Sollinger; Chrisian Schiel, both of Heidenheim, Germany

[73] Assignee: Voith Sulzer Papiermaschinen GmbH, Germany

[21] Appl. No.: 577,419

[22] Filed: Dec. 22, 1995

[30] Foreign Application Priority Data

Dec. 23, 1994 [DE] Germany ..... 44 46 308.1

[51] Int. Cl.[6] ..... B05C 1/08

[52] U.S. Cl. ..... 118/227; 118/249; 118/255; 118/257

[58] Field of Search ..... 427/209, 211; 118/224, 227, 249, 255, 262, 257; 162/358.3, 358.4, 358.5, 360.3

[56] References Cited

U.S. PATENT DOCUMENTS

| | | | |
|---|---|---|---|
| 3,866,566 | 2/1975 | Jones | 118/58 |
| 4,563,245 | 1/1986 | Wanke et al. | 162/358 |
| 5,409,534 | 4/1995 | Kustermann . | |
| 5,466,292 | 11/1995 | Kustermann . | |

FOREIGN PATENT DOCUMENTS

| | | |
|---|---|---|
| 0385640 | 9/1990 | European Pat. Off. . |
| 900870 | 8/1990 | Finland . |
| 95064 | 8/1995 | Finland . |
| 359174 | 10/1980 | Germany . |
| 4200771 | 7/1993 | Germany . |
| 4216634 | 11/1993 | Germany . |
| 4340039 | 7/1994 | Germany . |
| 2189714 | 11/1987 | United Kingdom . |
| 2205051 | 11/1988 | United Kingdom . |

*Primary Examiner*—Donald E. Czaja
*Assistant Examiner*—Steven B. Leavitt
*Attorney, Agent, or Firm*—Ostrolenk, Faber, Gerb & Soffen, LLP

[57] ABSTRACT

Several embodiments of an apparatus for applying a liquid or pasty medium e.g. a coating medium onto a moving material web of paper or board are disclosed. All embodiments include a first flexible endless loop belt having an inner surface that passes in contact with a sliding surface of a concave pressing shoe and an outer surface which contacts and moves a web through a press nip. In some embodiments, there is an opposing roll rotating along with the endless belt through the nip. Various devices can apply liquid or pasty medium onto the surface of the belt or the surface of the opposing roll. In an alternate apparatus, there are two counter rotating flexible endless belts which form the press nip between them through which the web is guided. The belts are pressed against each other by elongate guiding surfaces of respective pressing shoes inside the loops of the belts. These embodiments provide a longer length nip in the web travel direction to avoid film splitting during coating of the material web.

31 Claims, 12 Drawing Sheets

Fig.15 (State of the art)

APPARATUS FOR APPLYING A LIQUID OR PASTY MEDIUM ONTO A MOVING MATERIAL WEB

BACKGROUND OF THE INVENTION

The invention relates to an apparatus for applying a liquid or pasty medium, i.e., a coating medium, onto a moving material web, in particular a web consisting of paper or board.

DE 34 17 487 A1, which corresponds to U.S. Pat. No. 4,848,268, describes an apparatus in which a nip is formed between two rollers that rotate in opposite directions, and the material web to be coated, for example of paper, passes through the nip. Liquid or pasty medium is applied by application units with the aid of roll doctor blades onto the surfaces of the rolls and is then transferred onto the material web in the nip formed between both of the rolls. However, the problem of "film splitting" can arise during use of such apparatus. All of the film, consisting of the liquid or pasty medium, that was applied onto the roll surface may not be transferred onto the material web. Instead, a portion of the film to be applied releases from the material web and remains on the roll surface after discharge from the roll nip. This problem particularly occurs upon application of comparatively large amounts of liquid or pasty medium onto the material web. It causes a quality reduction with respect to the thickness and surface condition of the layer applied onto the material web.

SUMMARY OF THE INVENTION

The object of the present invention is to provide an apparatus for applying a liquid or pasty medium onto a moving material web wherein the apparatus enables the medium to be applied with comparatively large layer thicknesses and good quality.

According to the invention several embodiments of an apparatus for applying a liquid or pasty medium, e.g. a coating medium, onto a moving material web of paper or board are disclosed. All embodiments include a first flexible endless loop belt having an inner surface that passes in contact with a sliding surface of a pressing shoe and an outer surface which contacts and moves a web through a press nip. In some embodiments, there is an opposing roll rotating in a direction opposite the direction of the endless belt. The cylindrical outer surface of the opposing roll forms a nip together with the outer surface of the endless belt in the region of the sliding surface of the pressing shoe which the web passes. The sliding surface of the pressing shoe is concavely curved in its cross section and is pressable toward the opposing roll. The entry and exits into the nip at the shoe may be convexly rounded. Various devices for applying liquid or pasty medium onto the surface of the belt or the surface of the opposing roll are disclosed.

In an alternate apparatus, there are two counter rotating flexible endless belts which form the press nip between them through which the web is guided. The belts are pressed against each other by the guiding surfaces of respective pressing shoes inside the loops of the belts. The sliding surfaces of the opposed shoes are preferably flat.

These embodiments provide a longer length nip in the web travel direction to avoid film splitting during coating of the material web.

In accordance with several preferred solutions, the apparatus uses a flexible rotating endless loop belt and an opposing roll which rotates in the opposite direction to the belt. The belt and the roll form a nip between them at their outer surfaces, through which the material web to be coated is passed. In the area of the nip, the inner surface of the belt moves in contact with and past a sliding surface of a pressing shoe which is capable of being pressed in the direction toward the opposing roll. The sliding surface of the pressing shoe is concavely curved in its cross section extending perpendicular to the axis of the opposing roll.

Finally, known means are provided for applying a liquid or pasty medium onto the outer surface of the endless belt and/or the outer surface of the opposing roll. Such means can, for example, comprise application units with doctor elements either in the form of an application pressure chamber or in the form of an application sump with a free liquid surface, as application units with free jet nozzles, or as through-run troughs for the opposing roll or the endless belt. Additionally, the means can be a twin roll pre-dosing system comprising a sump with a free liquid surface, application rolls with spray application means, through-run troughs, or the like, or as direct application sump systems which form a sump with a free liquid surface directly between the material web and the outer surface of the opposing roll and/or the outer surface of the endless belt. The means for applying of the liquid or pasty medium can, however, also be in the form of other known designs. Depending on whether one-sided or two-sided application of the liquid or pasty medium onto the material web is desired, such applying means can be arranged either on the endless belt or on the opposing roll or even on both of them. On account of the concavely curved design of the sliding surface of the pressing shoe, the endless belt moving in contact past the sliding surface also becomes concavely curved in this region, in cooperation with the cylindrical outer surface of the opposing roll. In contrast with known apparatus in which two cylindrical, i.e. convexly curved roll surfaces, lie opposite each other to define a short length nip, a substantially longer or extended nip is provided in which the liquid or pasty medium to be applied can be transferred from the endless belt and/or the opposing roll onto the material web. In comparison with commonly known apparatus, a substantially thicker layer can be applied onto the material web with good quality in this extended application nip.

The phase of de-watering the applied medium occurs in a substantially slower and more uniform manner in the extended nip, which also produces a better surface of the applied layer. Therefore, a substantially greater amount of solid substances, such as color pigments in the medium to be coated, can be applied onto the material web and immobilized in the nip. As a result of the extended dwelling time of the material web in the nip, the liquid of the medium to be applied can therefore penetrate better into the material web and thus immobilize the applied layer. Consequently, upon the web exiting the nip, the invention avoids the rerelease of an upper layer of the film that had been transferred onto the material web and the adhesion of the film either to the outer surface of the opposing roll or to the endless belt, which might occur if the film layer still contains too much liquid. Re-releasing of an upper layer of the applied film, which had not yet been immobilized sufficiently upon the discharge of the web from the nip, i e., so-called "film splitting" is therefore effectively avoided with the invention. The use of an extended nip permits the pressing force applied onto the passing material web in the nip to be reduced, in comparison with commonly known apparatus.

In a preferred embodiment of the invention, the contour of the concavely curved sliding surface of the pressing shoe is adapted to the outer contour of the cylindrical opposing roll. It is particularly expedient if the radius of curvature of the concavely curved sliding surface of the pressing shoe has a similar size or is somewhat larger than the radius of curvature of the opposing roll plus the thickness of the endless belt.

In advantageous embodiments, the contour of the concavely curved sliding surface of the pressing shoe can be selected with reference to the outer contour of the opposing roll such that the distance between the sliding surface of the pressing shoe and the outer surface of the opposing roll remains constant along the extent of the nip or such that the distance between the sliding surface of the pressing shoe and the outer surface of the opposing roll decreases in the direction of web movement through the nip. The latter embodiment provides favorable pressure distribution upon movement of the material web, in that the pressure applied by the pressing shoe onto the material web increases along the passage of the web through the nip. Appropriate formation of the contour of the concavely curved sliding surface of the pressing shoe and its arrangement with respect to the outer contour of the opposing roll, for example, causes either a progressive pressure distribution in the nip or a constant pressure distribution. For example, in order to achieve a progressive pressure distribution in the gap, the radius of curvature of the sliding surface of the pressing shoe can be varied along the length of the nip or the pressing direction of the pressing shoe with respect to the opposing roll can deviate from the radial direction with respect to the roll surface.

In a preferred embodiment, the nip through which the material web passes for the application of the liquid or pasty medium is configured by the shape of the sliding surface of the pressing shoe to provide a smooth inlet for the material web into the nip and to provide a high pressure peak of the pressing force acting on the material web at the web exit from the nip. The sliding surface of the pressing shoe is in this case designed so that it moves closer to the outer contour of the cylindrical opposing roll in the passage through the nip. This extension of the sliding surface closer to the surface of the opposing roll is preferably provided by changing the radius of curvature of the sliding surface from a larger to a smaller concave radius of curvature in the direction of passage of the material web. On the one hand, this provides a very smooth entry into the nip for the material web to be coated while on the other hand, it provides a progressive pressure distribution on the passing material web which ends with a high pressure peak. As a result, the pigment layer of the medium applied is progressively immobilized.

In order to design the entry of the material web into the nip to have even fewer problems, in the previously described embodiment, the inlet side or nip entrance region of the sliding surface of the pressing shoe is convexly rounded off.

In a further advantageous embodiment of the invention, the outlet or exit edge region of the concavely curved sliding surface at the running out side of the nip, with reference to the passage of the web, is convexly rounded off. This produces abrupt separation of the outer surface of the endless belt from the web because the endless belt is guided away from the web at the running out side over the convexly rounded off end of the sliding surface. Depending on whether the liquid or pasty medium is applied onto one side of the web by means either of the endless belt or the opposing roll or the medium is applied on both sides of the web, the web can then be led away after exiting from the nip in a favorably altered direction for causing prompt separation of the web from the respective film applying outer surfaces. The occurrence of so-called "film splitting" is further reduced in this way. The convex radius of the entrance and exit edge regions of the sliding surface are preferably very much smaller than the concave radius of curvature of the sliding surface of the pressing shoe. The small rounded off radius at the nip exit end enables the endless belt to be led away with an appropriately larger change in direction, in comparison to the direction of passage of the web at the end of the nip.

In a further advantageous embodiment of the invention, the endless belt is guided away from the end region of the sliding surface of the pressing shoe is at an angle $\alpha_1$ to the direction of movement of the material web at its point of release from the surface of the opposing roll. Additionally, the material web is guided away from the surface of a opposing roll at an angle $\alpha_2$ to the tangent at the opposing roll surface at the point of release of the material web. Preferably, both of the angles $\alpha_1$ and $\alpha_2$ are selected so that:

$$|\alpha 1-\alpha 2| \leq 0.3\ \alpha 1+\alpha 2$$

In particular, a configuration is preferred in which the angle $\alpha_1$ is the same as the angle $\alpha_2$. The web is therefore guided away from the nip between the opposing roll surface and the outer surface of the endless belt so that where the material web separates from the opposing roll surface and from the endless belt outer surface, there are respective angles $\alpha_1$ and $\alpha_2$ to the surfaces which produces quick separation of the web from the adjacent surfaces. This geometric configuration is preferably realized by providing a convex rounded off radius at the outlet side edge region of the sliding surface of the pressing shoe and by a corresponding geometric arrangement of the guiding or deflecting rolls for the endless belt and the web downstream of the point of release at the outlet side.

Apparatus for applying a medium onto a moving material web, in which the material web is moved through a nip formed between a flexible endless belt and a opposing roll rotating in the opposite direction, are known in principle, for example, from DE 42 16 634 A1 or DE 42 00 771 A1. In these apparatus, the rotating endless belt is respectively guided through a trough filled with the medium to be applied and, for transfer of this medium onto the material web, it is pressed in the application nip by a pressing shoe in the direction toward the opposing roll. In DE 42 16 634 A1 the sliding surface of the pressing shoe, which is contacted by the endless belt passing through the application gap, is continuously convexly curved. In another case, the sliding surface is provided on a convexly curved base surface with a more strongly convexly curved projection. In both cases, there is a very short application nip between the endless belt and the opposing roll. Similarly, the sliding surface of the pressing shoe according to DE 41 00 771 A1 is continuously convexly curved. Therefore, these known constructions did not recognize the possibility of using a substantially longer application nip, in comparison with previously known apparatus, to avoid the undesired "film splitting" by using at least one flexible endless belt.

A further known apparatus described in EP 0 385 640 B1 avoids "film splitting" by providing the outer surface of one of two rollers, between which a nip is formed and through which the material web to be coated passes, with rubber material. This is a different solution than the present invention. The use in the invention of a flexible endless belt in connection with a correspondingly contoured sliding surface of a pressing shoe and in comparison with the very limited nip length achievable by means of a rubber layer on one of the opposing rolls, provides a desirably long nip length appropriate for the requirements, whereby undesired "film splitting" can be avoided more effectively. Consequently, high quality coatings can be applied onto the material web for large layer thicknesses with the invention.

In another embodiment of the invention, the apparatus for applying a liquid or pasty medium onto a moving material web includes a first rotating flexible endless loop belt and a second flexible endless loop belt which rotates in the opposite direction. The belts meet to form a nip through which the material web to be coated is passed. A respective shoe is disposed inside each endless loop belt against the opposable side of the belt path. Both pressing shoes are capable of being pressed in directions toward each other. The contours of both of the sliding surfaces of the pressing shoes are adapted to each other such that an extended nip is formed between both of the sliding surfaces and thus between the cooperating outer surfaces of the endless belts passing in contact with each other as they pass the sliding surfaces. Means for applying the liquid or pasty medium onto the outer surface of one of the two endless belts or onto the outer surfaces of both endless belts are provided. The design of these known means was explained above.

Because the contours of both sliding surfaces of both pressing shoes are adapted to each other to form an extended nip, in comparison to commonly known apparatus, so-called "film splitting" is avoided and comparatively large layer thicknesses of the liquid or pasty medium on the material web can be realized with good quality. The advantages which can be achieved by the extended nip formation of the invention are described above. Preferably, the sliding surfaces of both of the pressing shoes are flat. This provides easily and cheaply producible contours for the sliding surfaces.

In another embodiment, one of the two sliding surfaces is concave in cross section while the other sliding surface is convex in its cross section, and the outer contours of the two sliding surfaces are adapted to each other. In an expedient embodiment, the radius of curvature of the concavely curved sliding surface substantially corresponds to the radius of curvature of the convexly curved sliding surface.

In preferred embodiments, the distance between the two flat or curved sliding surfaces remains either substantially constant or it decreases in the direction of passage of the material web along the extent of the nip. In the latter design with the decreasing nip spacing, as already explained, progressive distribution of pressure applied on the passing material web can be achieved. However, it is also possible to choose a degressive pressure gradient where the sliding surfaces have gradually increasing spacing between them. This would cause the compressed pores in the paper to open again somewhat and the web can thus "suck" toward the end of the contacting surface.

In order to ensure entry of the material web into the nip without any problem, it is expedient to round off the regions of the sliding surfaces of the pressing shoes at the inlet side. This can also be useful in the previously described embodiment which has a decreasing nip spacing in the direction of passage and in which smooth web entry is already obtained by means of the wider nip opening at the inlet side.

It is advantageous to provide the outlet end regions of the sliding surfaces of the pressing shoes with respect to the passage of the material web with a respective convex rounding off. This rounding off preferably has a comparatively smaller radius of curvature so that the two endless belts can be favorably guided away to the side from the material web after passage through the nip and so that abrupt separation of the material web from the endless belts can occur, which additionally reduces the "film splitting".

Further preferred embodiments of the invention are now explained.

In a useful embodiment, each pressing shoe is respectively supported on or in a fixed supporting body on which the shoe is displaceable in its pressing direction. An hydraulic or pneumatic pressing apparatus for pressing the pressing shoe is preferably provided in the supporting body. However, in a preferred embodiment, each pressing shoe is provided with pressing means which are adjustable zone-wise in pressing force across the width of the passage of the material web. Therefore, the pressing force in the application nip can be varied zone-wise to adapt to requirements during operation. Further, it is expedient for support of the rotating endless belts to arrange on the supporting body at least one fixed supporting shoe having a support surface.

In advantageous embodiments, a driving roll frictionally engages and actuates the endless belt applied. Either the inner surface or the outer surface of the endless belt is frictionally engaged. When a driving roll is applied to the outer surface of the endless belt, it is useful to provide a cleaning element, such as a cleaning scraper, on the outer surface of the driving roll in order to remove residues of liquid or pasty medium which are possibly present on the outer surface of the endless belt and may be transferred onto the driving roll. If the driving roll acts on the outer surface of the endless belt, it is advantageous to provide a counter element, for example, a supporting shoe, opposite the driving roll and within the loop of the endless belt. In a further advantageous embodiment of the invention, the actuation of the endless belt takes place by means of known mantle supporting discs located on the edges of the supporting body.

In a useful embodiment the endless belt is driven by frictional engagement with the edge regions of the opposing roll surface which do not contact the material web.

In a further embodiment of the invention, within the loop of the endless belt, there is a further inner endless belt which rotates in the same direction and is guided in contact between the inner surface of the first endless belt and the sliding surface of the pressing shoe. The inner endless belt is guided by the sliding surface of the pressing shoe and at the supporting shoe of the carrying body, while the outer first rotating endless belt is additionally guided over the sliding surface of the pressing shoe by means of rolls which are distributed as driving and/or tensioning rolls, as deflection rolls or regulating rolls along the length of the endless belt.

It is useful for the endless belt to be flat surfaced at its outer side in order to aid in transferring the liquid or pasty medium onto the material web and to be roughened at the inner side of the endless belt for better frictional engagement with the respective driving apparatus. The endless belt is preferably designed as a flexible plastic belt or rubber belt, possibly with reinforcing fibers or layers of reinforcing threads as known, for example, from EP 0 469 338 B1 (U.S. Pat. No. 5,320,702) for the press mantle of a web pressing means.

Preferably, the means for applying the liquid or pasty medium comprise doctor application units with a pressure chamber or may comprise a sump, or free jet nozzle application units, run through application units, twin-roll predosing systems with the formation of a sump, application rolls with spray application means, through-run troughs, or the like, or direct application sump systems. In the direct application sump system, depending on whether there is to be one-side or two-side application of the liquid or pasty medium, a sump with a free liquid surface is formed directly upstream of the application nip and between the material web and the opposing roll surface and/or between the material web and the outer surface of the endless belt or the outer surfaces of the endless belts. Other known application units can also be used in an advantageous manner according to the invention.

In the following, preferred exemplary embodiments of the invention are now described in more detail with reference to the enclosed drawings.

BRIEF DESCRIPTION OF THE DRAWINGS

FIG. 15 shows an illustration of basic principles of a known prior art roll nip.

DESCRIPTION OF THE PREFERRED EMBODIMENTS

Figure 1:
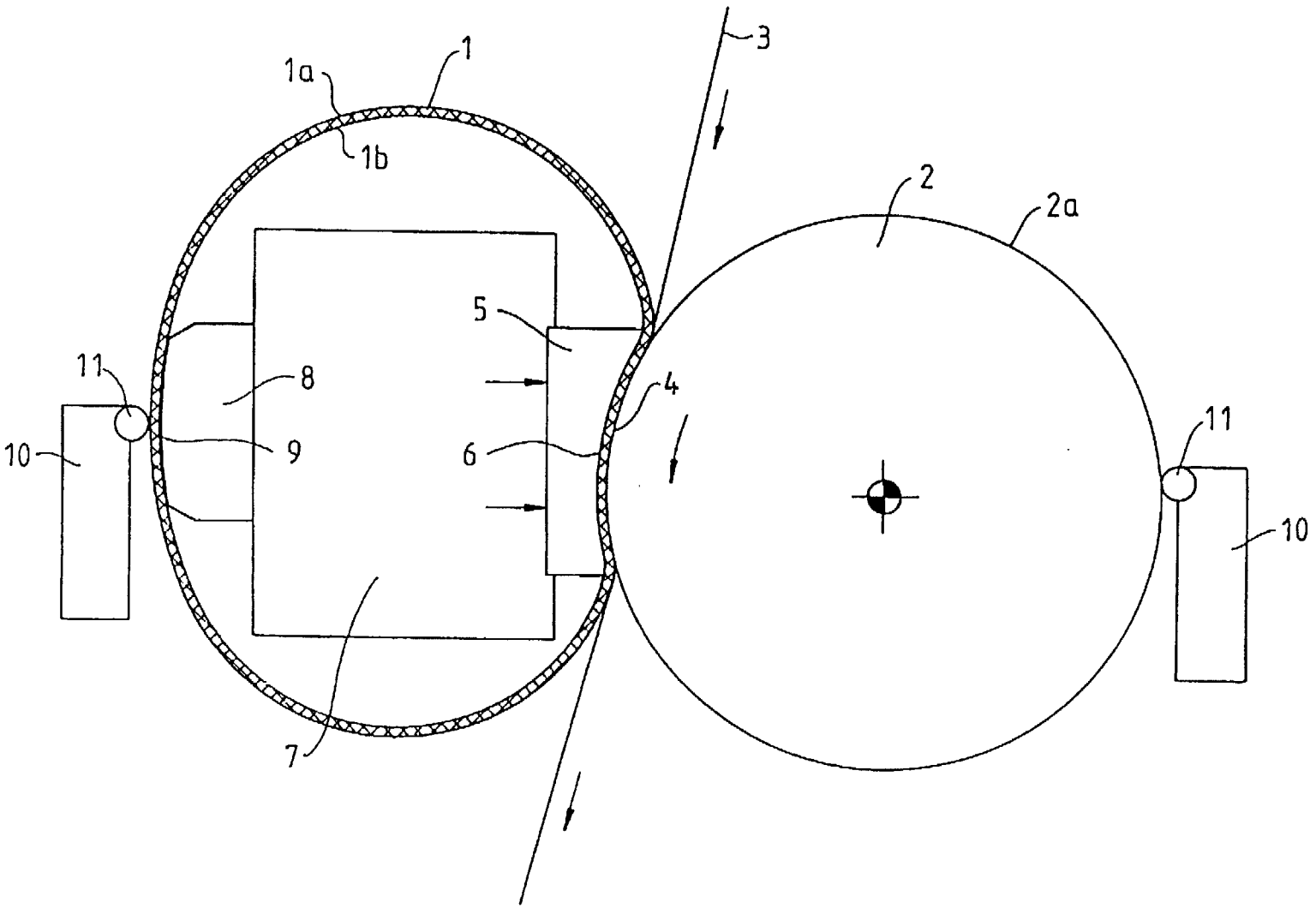
FIG. 1 shows a schematic side view of a first exemplary embodiment of the invention.

The first exemplary embodiment of the invention shown in FIG. 1 includes a flexible endless loop belt 1 comprised of plastic or rubber which is possibly provided with reinforcing fibers. The endless belt 1 is guided over a sliding surface 6 of a pressing shoe 5 at the inner side of the belt and over a supporting surface 9 of a supporting shoe 8 at the inner side of the belt loop which is opposite the shoe 5. The supporting shoe 8 is illustrated in simplified schematic form and it can extend along a greater part of the endless loop belt. As an alternative to the supporting shoe 8 with its supporting surface 9, a supporting cylinder or supporting roll, which is not driven to rotate can be provided. This roll can reduce the presumably very high friction between the supporting surface 9 and the interior 1*b* of the endless belt, whereby the drives save energy. Additionally, the belt and the supporting element are subjected to less wear. The supporting body therefore has a supporting surface which is appropriately adapted to the curvature of the supporting roll.

Further, the apparatus has a driven opposing roll 2 which rotates in the direction of the arrow (counter-clockwise). A nip 4 is formed in the area of the sliding surface 6 of the pressing shoe 5 between the outer surface 1*a* of the endless belt 1 and the outer surface 2*a* of the opposing roll 2 through which a material web 3 comprised, for example, of paper, board or a textile material is guided in the direction of the arrow. The pressing shoe 5 is displaceably supported on a supporting body 7 and is hydraulically or pneumatically pressed toward the opposing roll 2 in the direction of the arrow by means of known shoe pressing means (not illustrated). The interior surface 1*b* of the endless belt 1 in this case closely conforms to the contour of the sliding surface 6 of the pressing shoe 5. The sliding surface 6 is concavely curved in its cross sections extending perpendicular to the longitudinal axis of the opposing roll 2. The curvature is adapted to the curvature of the cylindrical outer surface 2*a* of the opposing roll. See FIG. 14. Therefore, the outer surface 1*a* of the endless belt 1 closely follows the contour of the outer surface 2*a* of the opposing roll 2 in the area of the pressing shoe 5. This results in a comparatively long nip 4 in which the material web 3 is pressed by the pressing shoe 5 against the surface 2*a* of the opposing roll 3.

On the outer surface 1*a* of the endless belt 1 as well as the surface 2*a* of the roll 2 there is a respective liquid or pasty medium application unit 10 (only schematically illustrated) which includes a doctor element 11, such as a roll doctor. These application units 10 apply a liquid or pasty medium, such as a coating color with pigments, onto the outer surface 1*a* of the endless belt 1 and onto the surface 2*a* of the opposing roll 2 in order for the medium to be subsequently transferred in the nip 4 onto both sides of the material web 3. Should only one side coating of the material web be desired, only one of the two application units 10 need be present or only one of the two is put into operation.

In this embodiment, the endless belt 1 is driven by the lateral edge regions of the surface 2*a* of the opposing roll 2, which lie on the outside in the direction of the roll longitudinal axis. These edge regions of the surface 2*a* drive the opposing regions of the outer surface 1*a* of the endless belt 1 through frictional engagement because these edge regions are not contacted by the web 3. Therefore, the endless belt 1 rotates in the opposite direction to the opposing roll 2.

Figure 2:
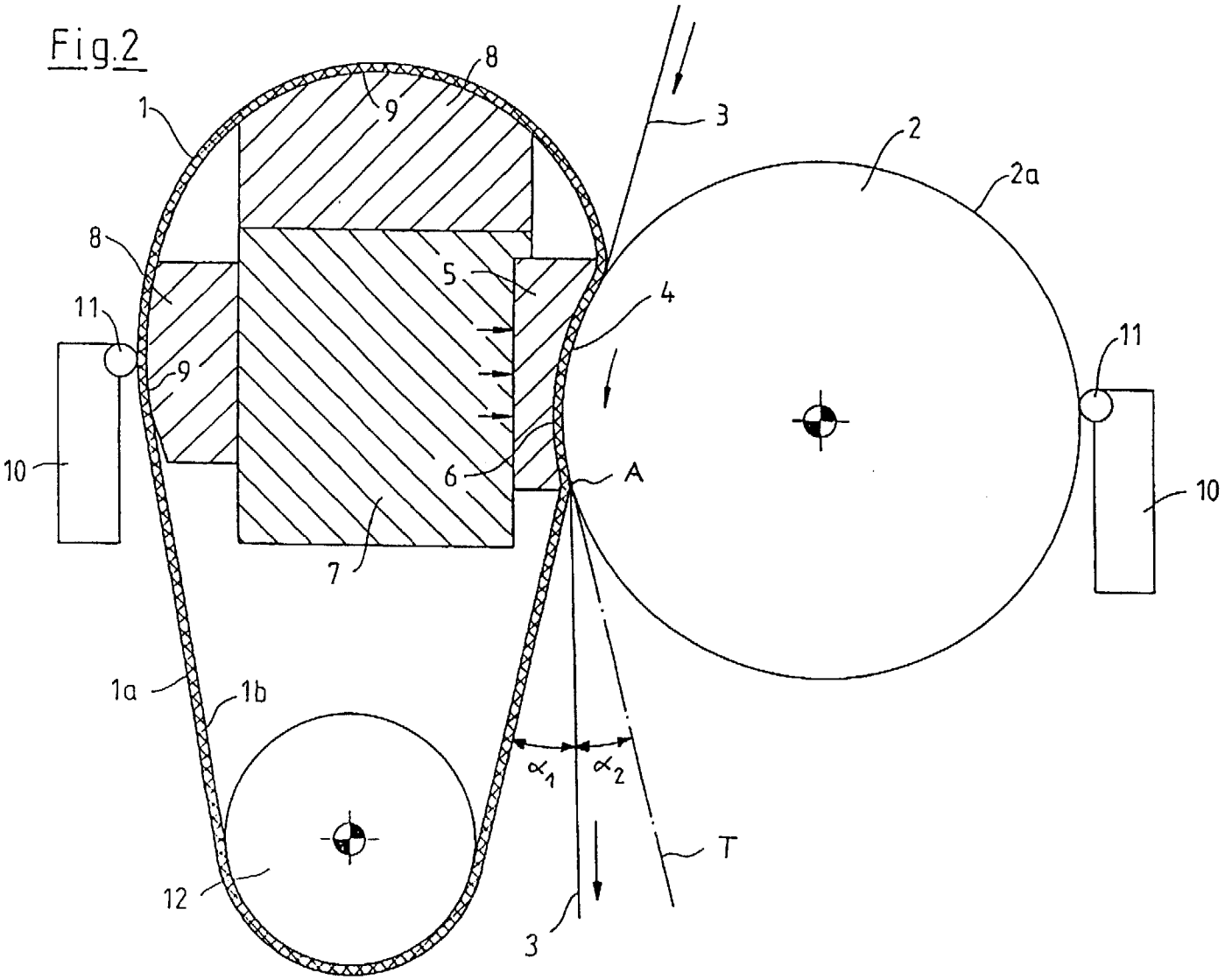
FIG. 2 shows a schematic side view of a second exemplary embodiment of the invention.

The second embodiment of the invention, shown in FIG. 2, is a variant of the first embodiment. The same or corresponding structural parts or components are designated with the same numbers as in FIG. 1 so that explanations of these elements appear above. In the first embodiment in FIG. 1, the endless belt 1 is driven indirectly, by means of the opposing roll 2. In contrast, the endless belt 1 in FIG. 2 includes its own drive. The inner surface 1*b* of the endless belt 1 is guided over a drive roll 12 by which it is driven by frictional engagement. In The inner surface 1*b* is roughened to ensure a driving force transfer from the drive roll 12 to the endless belt 1 without difficulties. The outer surface 1*a*, which transfers the liquid or pasty medium onto the material web 3, is smooth.

Figure 3:
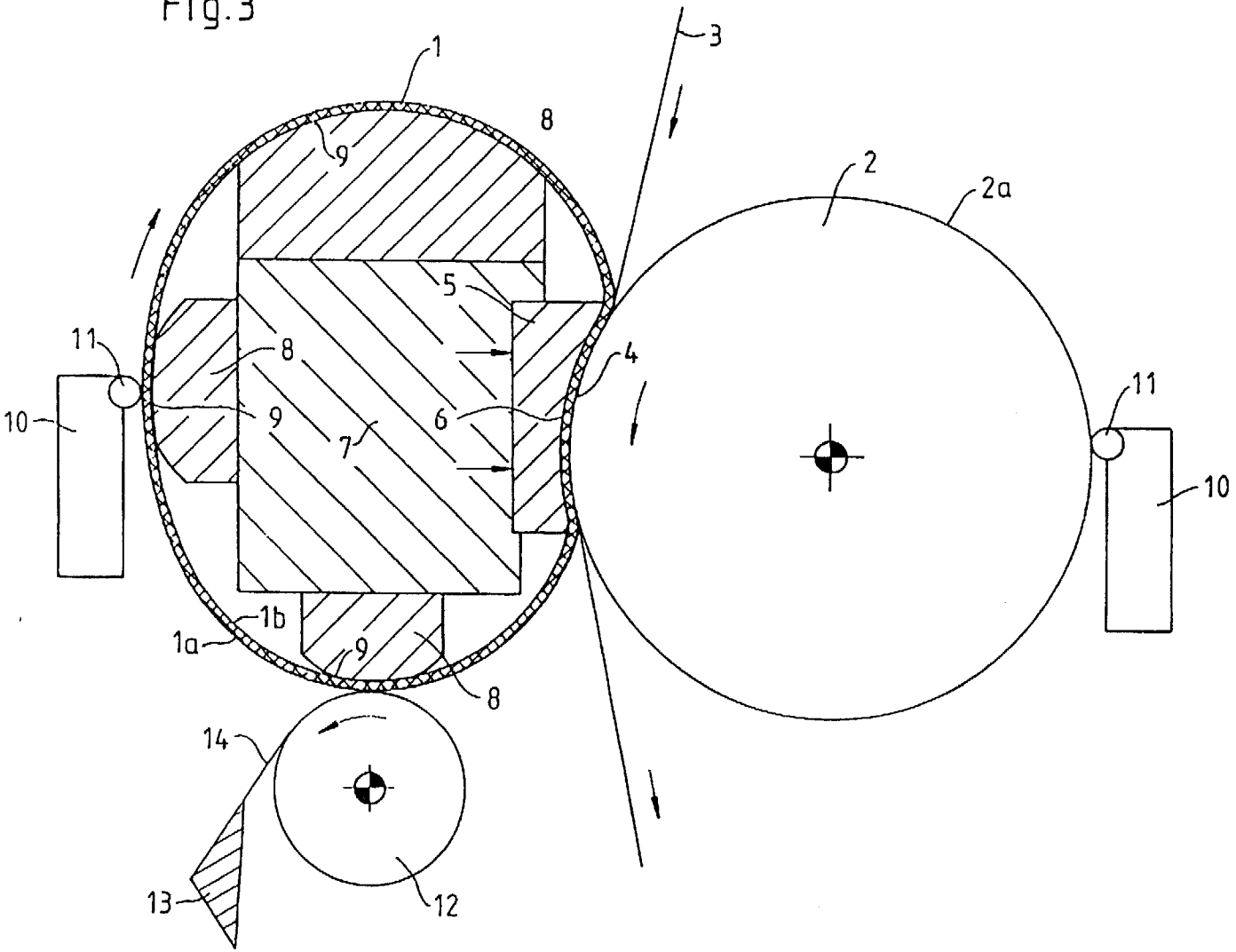
FIG. 3 shows a schematic side view of a third exemplary embodiment of the invention.

A further variant of the apparatus shown in FIG. 1 is illustrated as a third exemplary embodiment in FIG. 3. Also in FIG. 3, as in the following FIGS. 4 to 12, the same or corresponding components and structural groups are designated with the same reference numbers as in FIG. 1 and are described above. In the third embodiment according to FIG. 3, a drive roll 12 drives the outer surface 1*a* of the endless belt 1 in frictional engagement with the belt surface 1*a*. A cleaning means 13 including a cleaning blade 14 is arranged on the drive roll 12 to scrape off any residue of the liquid or pasty medium which has possibly been transferred from the outer surface 1*a* of the endless belt 1 onto the surface of the drive roll 12.

Figure 4:
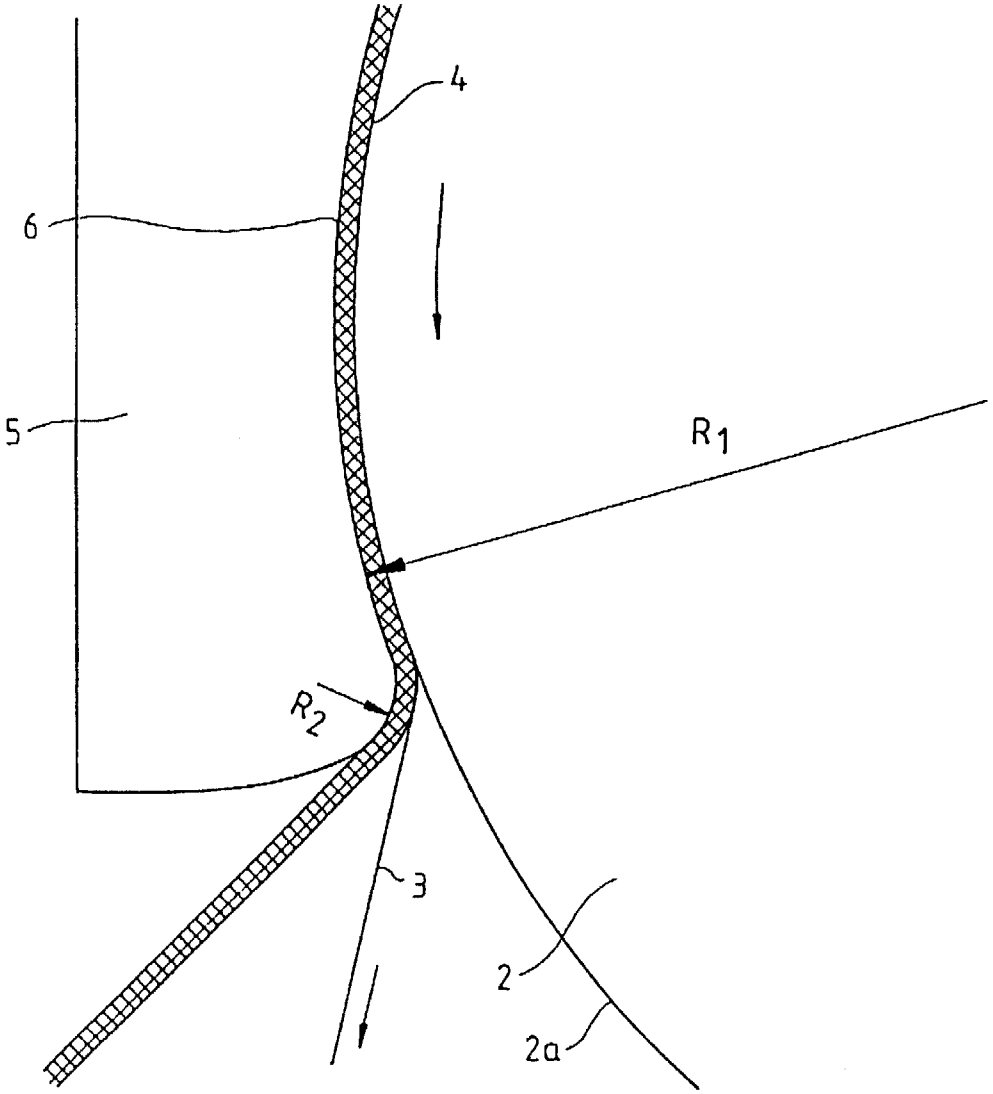
FIG. 4 shows an enlarged portion of the embodiments of FIGS. 1 to 3.

A detail of the apparatus in any of FIGS. 1, 2 or 3 is illustrated in FIG. 4. The concavely curved sliding surface 6 of the pressing shoe 5 passes into a convex rounded off radius $R_2$ in its edge region at the running out side, i.e. in the region where the web 3 exits from the nip. The radius of curvature $R_1$ of most of the remaining, concavely curved sliding surface 6 corresponds substantially to the radius of the outer surface 2*a* of the opposing roll 2. As a consequence of the convex rounding off of the outlet edge region of the sliding surface 6, the endless belt 1 can be subjected along a short length passage to a sharp change in direction and can be guided away to the side (in the direction toward the bottom right in the drawing) from the direction of rotation of the surface 1*a* of the opposing roll 2. Such guidance is achieved with appropriately placed guide rolls for guiding the endless belt, rolls like those shown in FIG. 5, for example. Therefore, the web 3 can also be subjected to a similar change in direction with respect to its direction of exiting out of the nip 4 by placement of guide means, like guide rolls, for the web. Consequently, depending on whether there is a one-side or two-side application of the liquid or pasty medium onto the web 3, as abrupt separation as possible of the web from the surface of the endless belt 1 or the surface of the opposing roll 2 or from both surfaces provided with the medium to be applied can be realized. The convexly rounded off radius R2 at the exit from the nip is much smaller than the radius of curvature R1 of the concave sliding surface 6.

Figure 5:
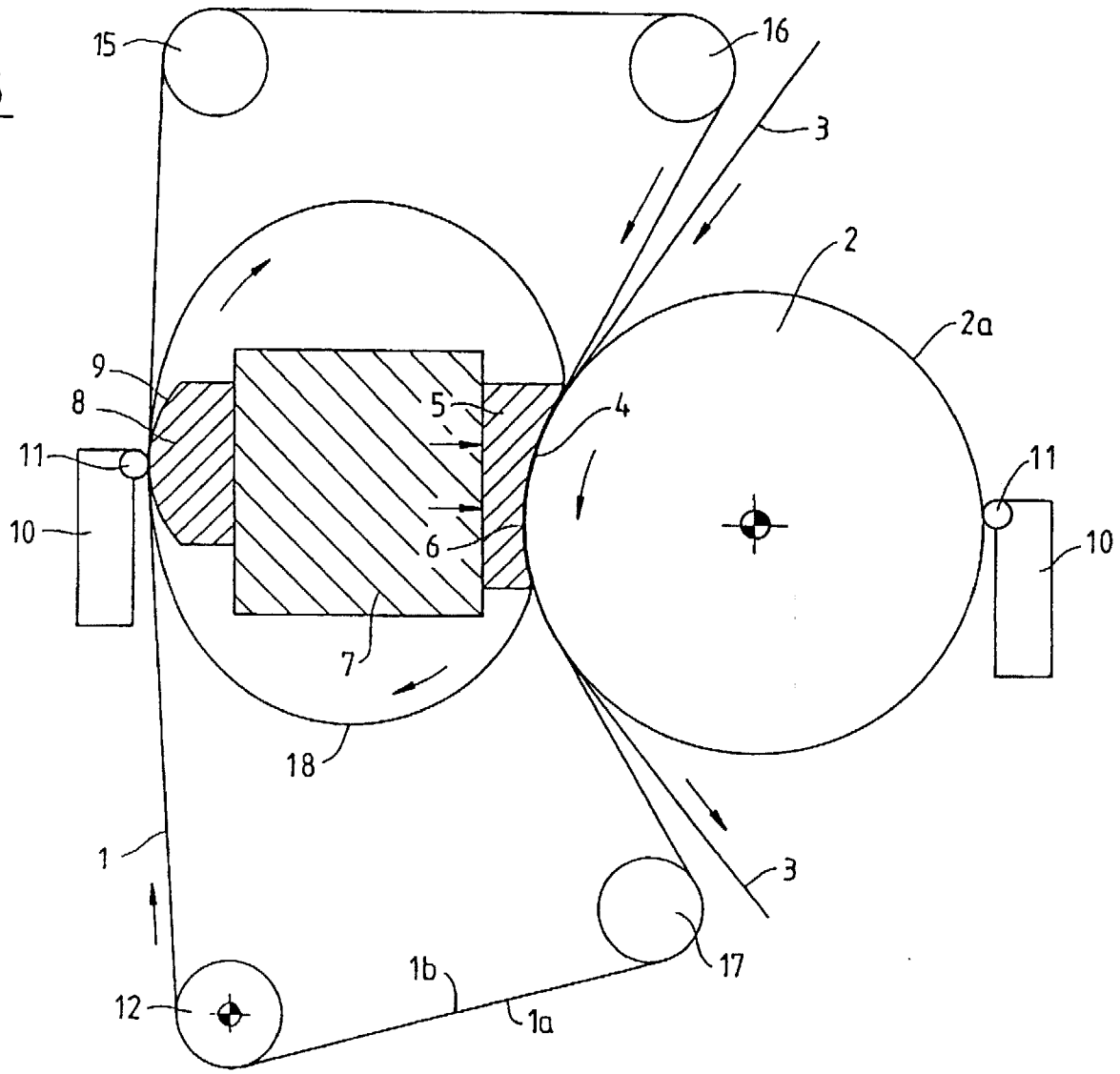
FIG. 5 shows a schematic side view of a fourth exemplary embodiment of the invention.

In the fourth embodiment of the invention illustrated in FIG. 5, the endless belt 1 is guided as an outer endless belt over several rolls 12, 15, 16 and 17. An additional inner endless belt 18 within the outer belt is supported similarly to and rotates in a manner corresponding to the endless belt 1 in FIG. 1. Both endless belts 1 and 18 pass together through the nip 4 between the sliding surface 6 of the pressing shoe 5 and the outer surface 2*a* of the opposing roll 2. Oil is provided onto the inner surface of the inner endless belt 18 for appropriate lubrication of the belt as it passes over the stationary shoe 5. Oil would also be provided in other embodiments where a belt 1 passes over a sliding surface. The outer endless belt 1 has a smooth outer surface 1*a* and a roughened inner surface 1*b*. The belt is used for the application of the liquid or pasty medium onto the web. For this purpose, the liquid or pasty medium is applied by the application unit 10 onto the smooth outer side 1*a* of the belt 1 and is transferred in the nip 4 onto the material web 3. The toughened inner surface 1*b* of the endless belt 1 is guided over a driving or tensioning roll 12, a setting roll 15 and two deflection rolls 16 and 17 placed, for example, to provide a desired approach angle and a desired departure angle for the belt 1, with reference to the path of the web and the shape of the shoe surface 6.

Figure 6:
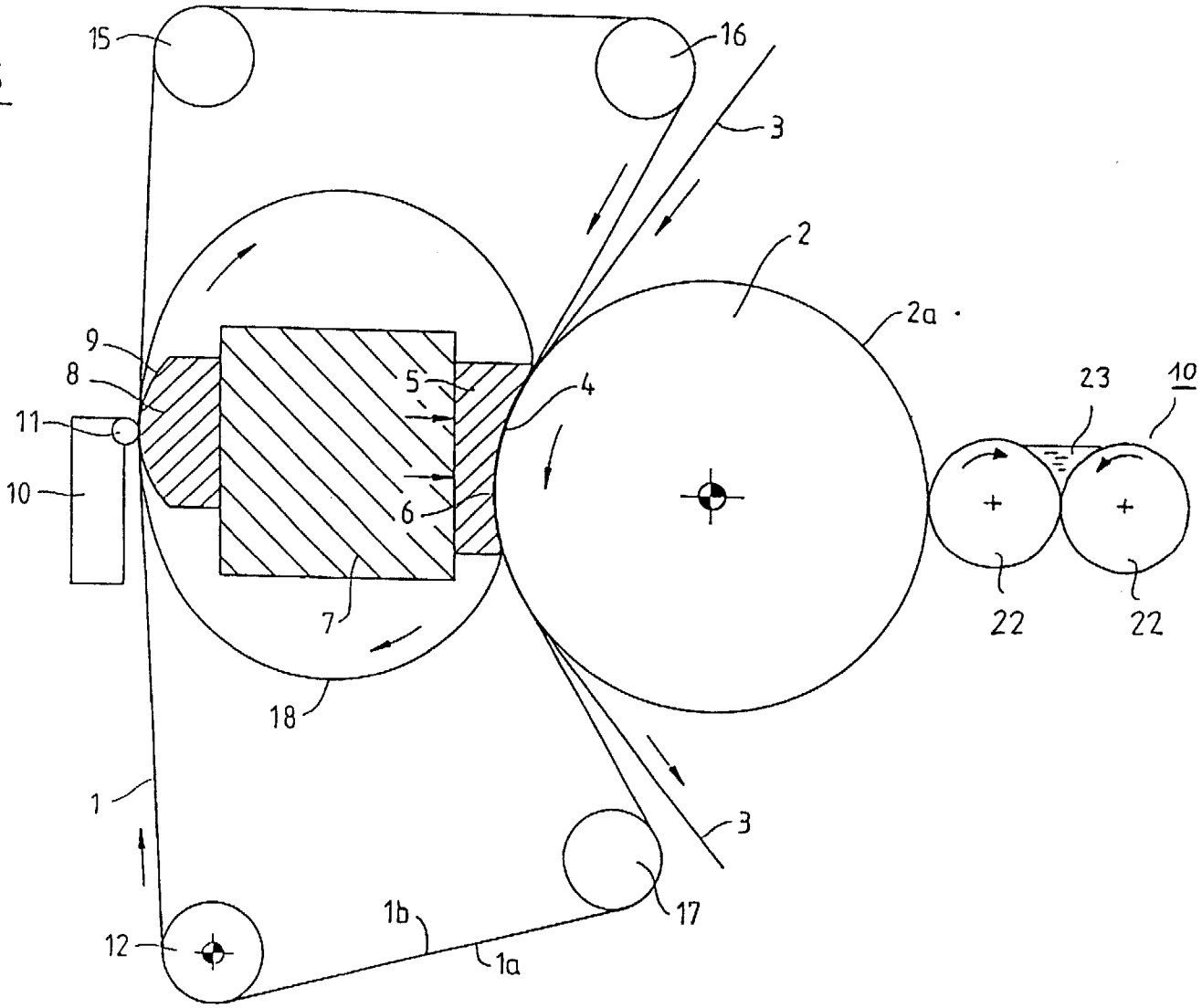
FIG. 6 shows a schematic side view of a first variant of the fourth embodiment of FIG. 5.

FIG. 6 shows a first variant of the fourth embodiment illustrated in FIG. 5 and described above. This first variant differs from FIG. 5 merely by the use of a different means 10, shown at the left in the illustration, for applying the liquid or pasty medium onto the surface 2*a* of the opposing roll 2. A twin roll pre-dosing system is formed by two rolls 22 which counter-rotate in the directions of the arrows. A sump 23 with a free liquid surface is formed between the rolls 20. The left hand roll 22 transfers the medium to be applied from its surface onto the opposing roll surface 2*a*.

Figure 7:
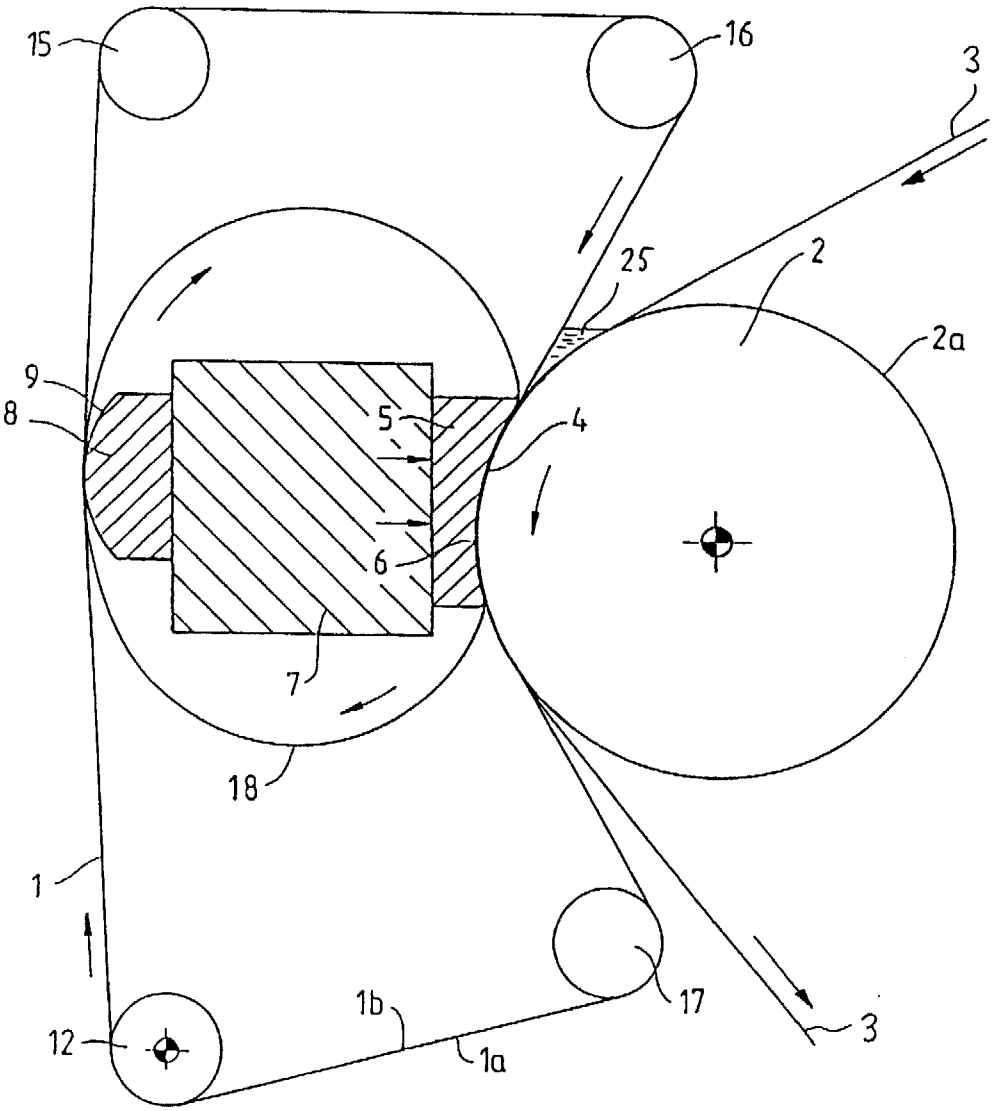
FIG. 7 shows a schematic side view of a second variant of the fourth embodiment of FIG. 5.

FIG. 7 shows a second variant of the fourth embodiment illustrated in FIG. 5. This second variant differs from the fourth embodiment merely by using a direct sump application system. The sump 25 has a free liquid surface. It is used instead of the application unit 10 illustrated in the fourth embodiment. The variant in FIG. 7 is designed for one side application of the liquid or pasty medium onto the material web 3. The sump 25 is formed, for example, directly upstream of the nip 4 between the material web 3 and the outer surface of the endless belt 1.

Figure 8:
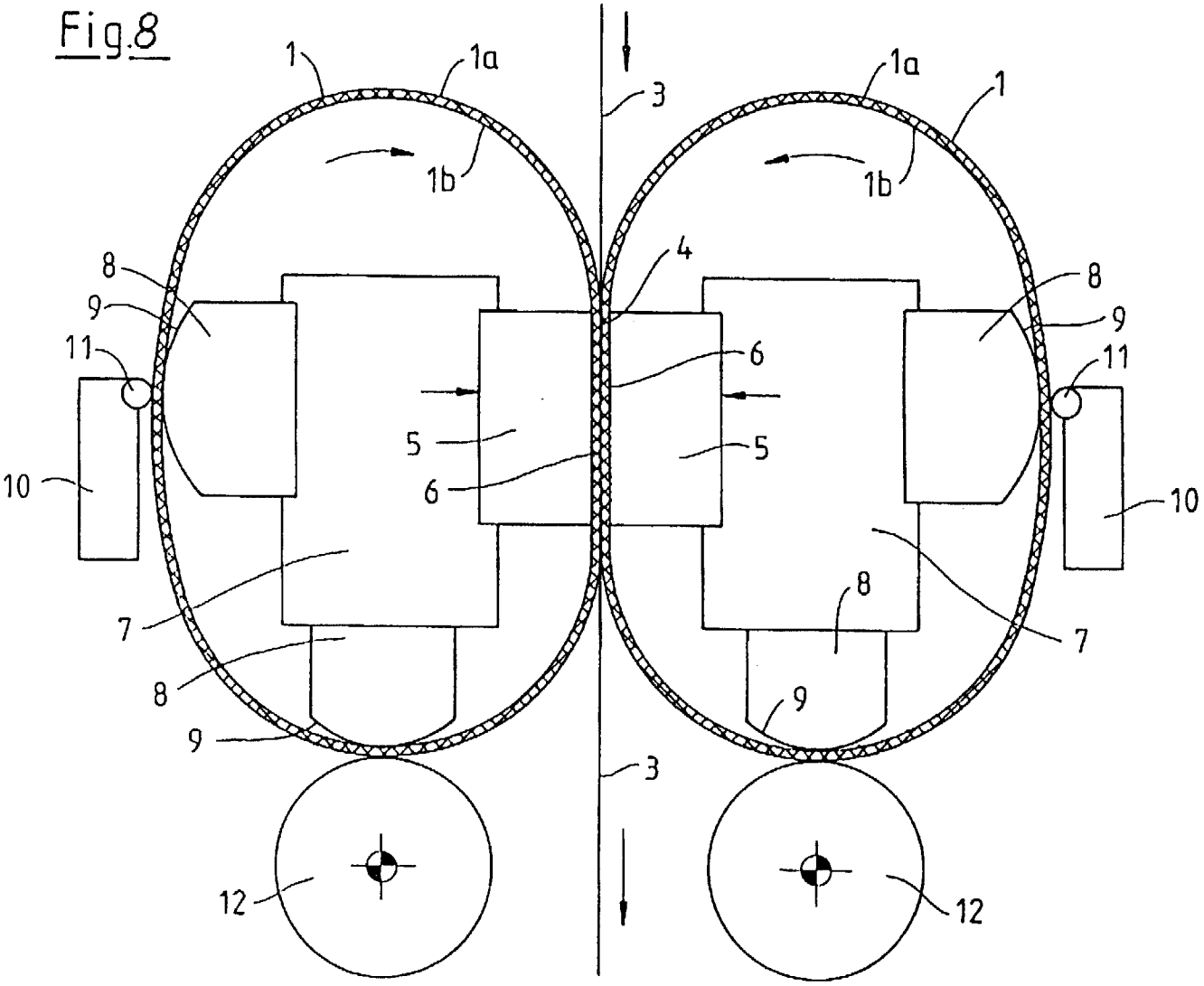
FIG. 8 shows a schematic side view of a fifth embodiment of the invention.

The fifth embodiment of the invention illustrated in FIG. 8 is designed in a mirror imaged manner with respect to the plane of the web which is guided from above to below through the nip 4. Two counter rotating endless belts 1 are driven by respective drive rolls 12 which frictionally engage the outsides of the respective belts. The outer surfaces 1*a* of the endless belts 1 form the nip 4 between them in the area of the opposed pressing shoes 5 inside the respective belt loops. The inner surfaces 1*b* of the endless belts 1 pass in contact past the shoe sliding surfaces 6 which are respectively flat and parallel to one another. Therefore, a straight nip 4 along the extent of the sliding surfaces 6 is provided in the direction of passage of the material web 3. Consequently, depending on the length dimensions of the sliding surfaces 6 along the web path, a substantially longer nip 4 can be realized in comparison to a nip formed between two cylindrical rolls.

Figure 9:
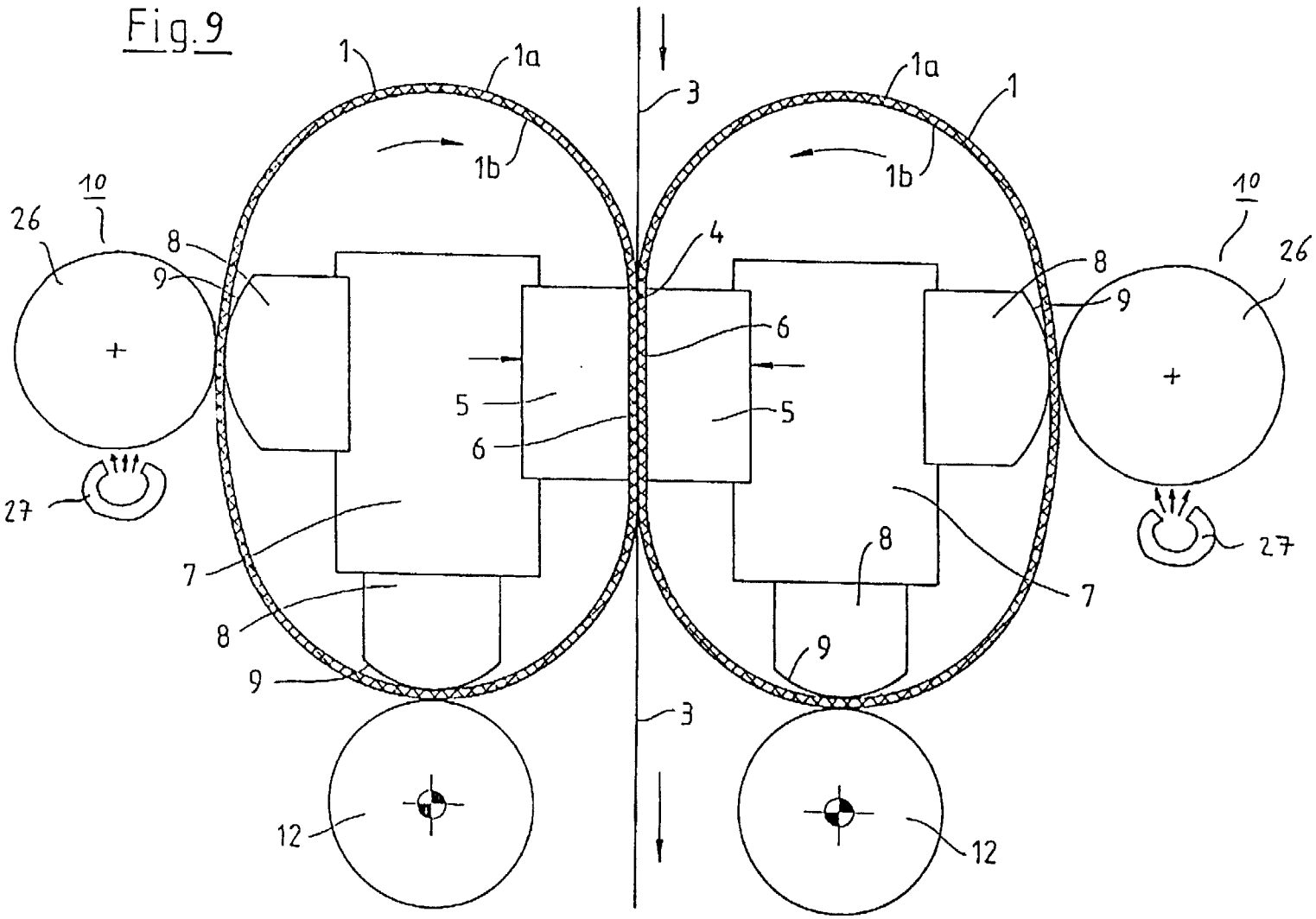
FIG. 9 shows a schematic side view of a variant of the fifth embodiment of FIG. 8.

FIG. 9 shows a variant of the fifth embodiment illustrated in FIG. 8, from which it differs merely in that the application unit 10 of FIG. 8 is replaced by respective application means 10 with application rolls 26. The liquid or pasty medium is applied onto the surfaces of the application rolls 26 by respective spray application means 27, but can as well be applied by means of other known application processes such as the drawing of the liquid or pasty medium out of a through run trough.

Figure 10:
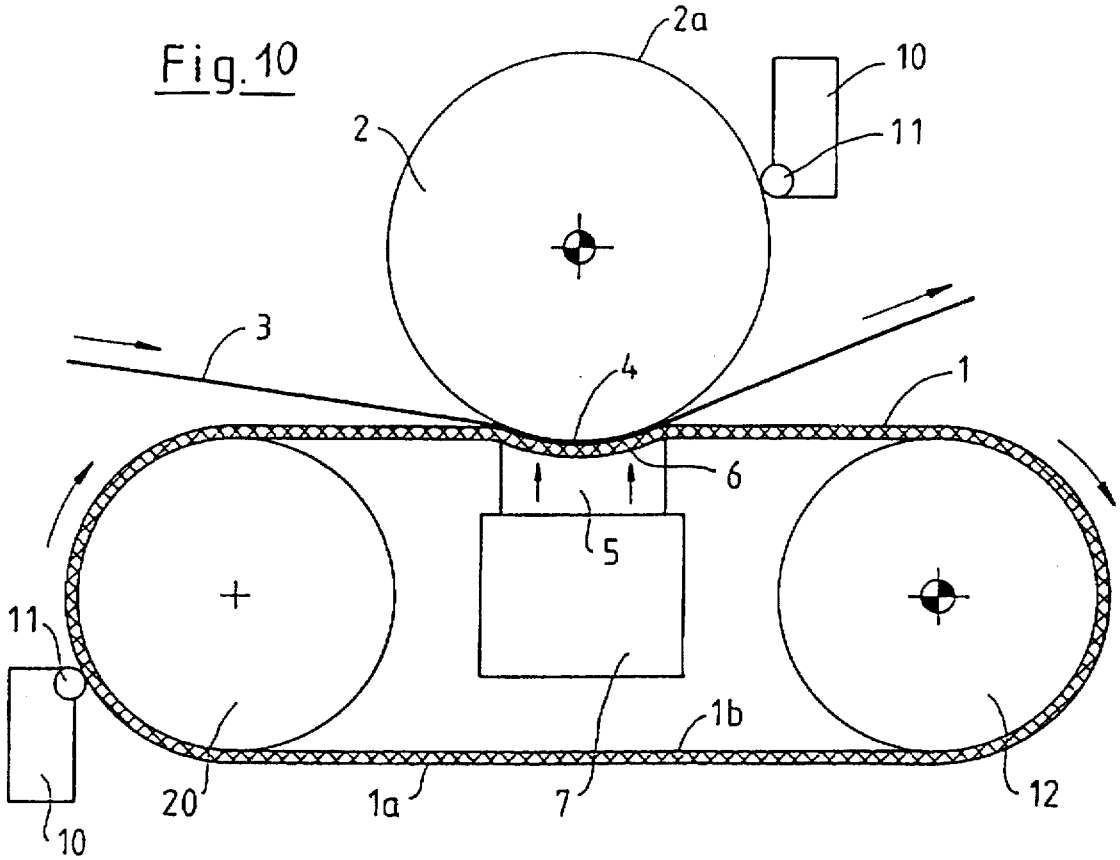
FIG. 10 shows a schematic side view of a sixth embodiment of the invention.
Figure 11:
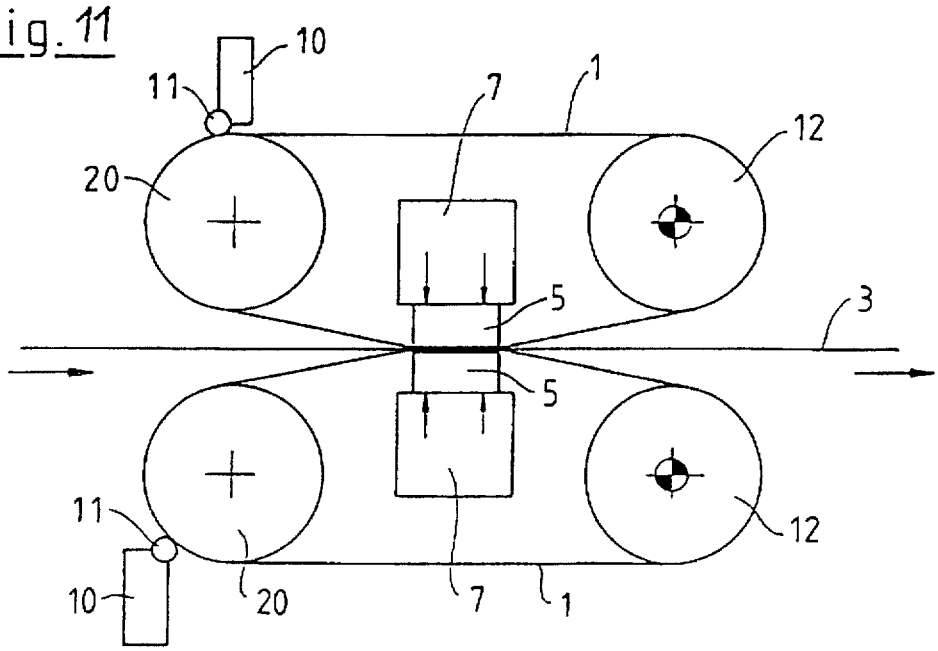
FIG. 11 shows a schematic side view of a seventh embodiment of the invention.

In both embodiments of the invention shown in FIGS. 10 and 11, the endless belts 1 respectively move about two spaced apart rolls, one of which is a drive roll 12 and the other is a deflection roll 20. The liquid or pasty medium is applied onto the outside of the respective endless belt 1 at the deflection roll 20 so that similar conditions prevail there as in the case of application of a medium onto the outer surface of an application roll. The liquid or pasty medium is then transferred in a nip 4 onto the passing web 3. The necessary pressing force in each case is supplied by pressing shoe 5 opposed to roll 2 in FIG. 10 or by opposed pressing shoes 5 in FIG. 11.

Figure 12:
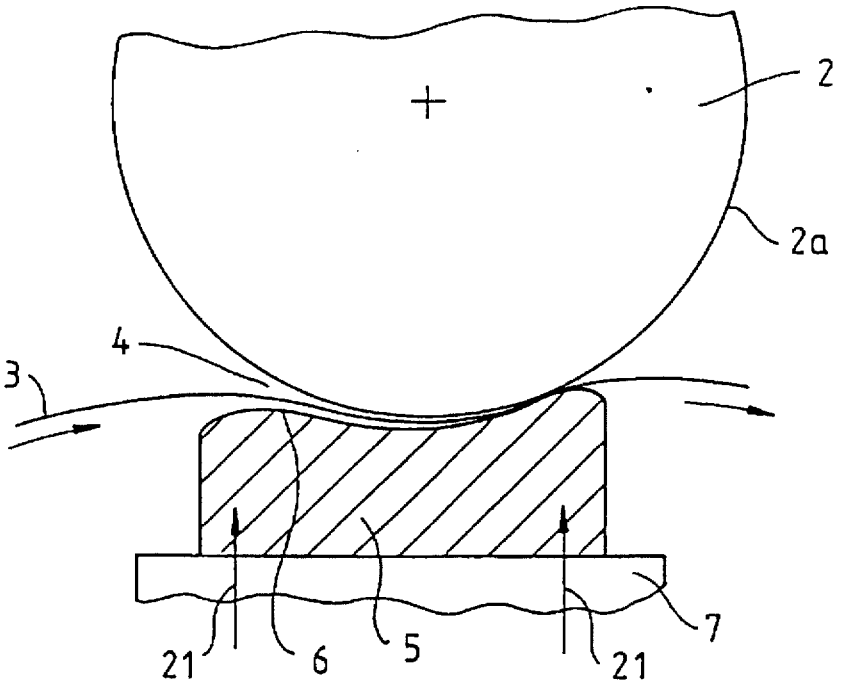
FIG. 12 shows a simplified schematic illustration of basic principles of an embodiment of a pressing nip configuration.

The fragment shown in FIG. 12 is not to scale. It shows the essential design features of this embodiment in the area of the nip 4. For a better overview, the endless belt that would normally be guided in contact over the sliding surface 6 has been omitted. The sliding surface 6 of the pressing shoe 5 is so designed with respect to the surface 2*a* of the opposing roll 2 that it allows smooth entry of the material web 3 into the nip, as well as an increase in pressure upon passage through the nip, leading to a high pressure peak at the outlet.

The end region of the sliding surface 6 at the nip inlet side (left-hand side in the drawing) is convexly rounded off to allow entry of the web into the nip without difficulty. The adjoining concavely curved area of the sliding surface 6 approaches closer to the outer contour of the opposing roll 2 in the direction of web passage through the nip path. The end region of the sliding surface 6 at the nip outlet side (right-hand side in the drawing) is also convexly rounded off to enable abrupt separation between the web 3 and the endless belt after the nip outlet.

Figure 13:
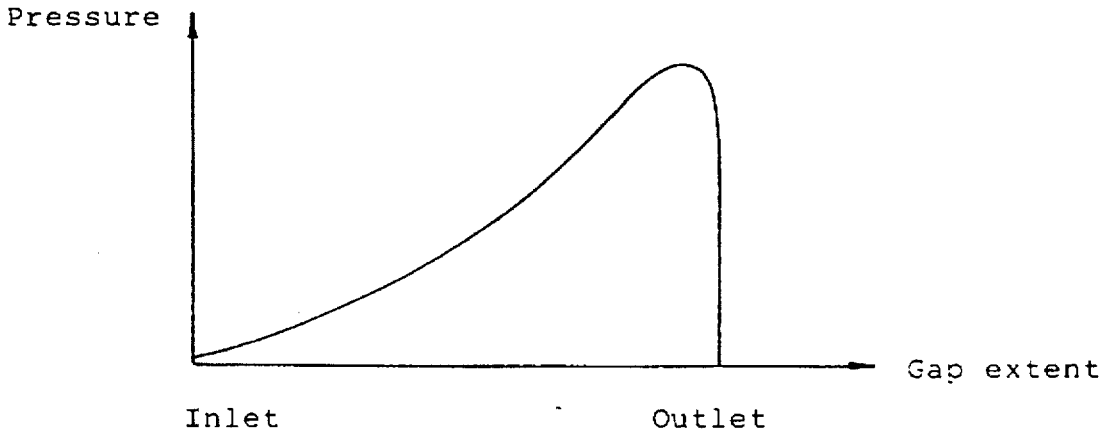
FIG. 13 shows a schematic illustration of the pressure distribution along the pressing nip in the embodiment in FIG. 12.

FIG. 13 schematically shows the pressure relationships along the nip passage. The pressure level initially increases continuously from the nip inlet up to a high pressure level at the nip outlet and then abruptly drops off. The particular design of the contour of the pressing shoe 5, with a smooth nip inlet and a high pressure peak at the nip outlet as shown in FIG. 12, immobilizes the pigment layer in the applied medium in a progressive manner. Known pressure adjusting means respectively act at the locations marked with arrows 21, i.e. at the nip inlet and at the nip outlet.

Figure 14:
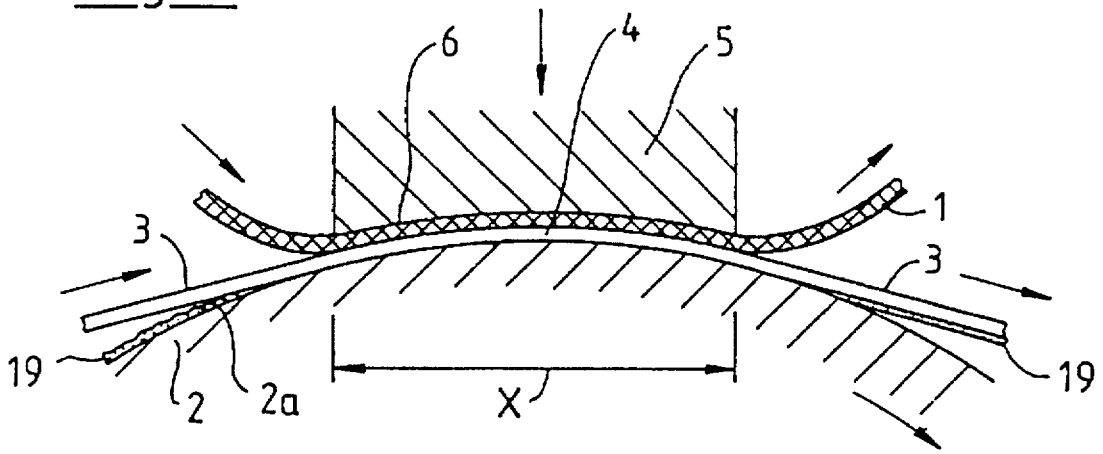
FIG. 14 shows a simplified illustration of basic principles of an extended nip according to the invention.
Figure 14:
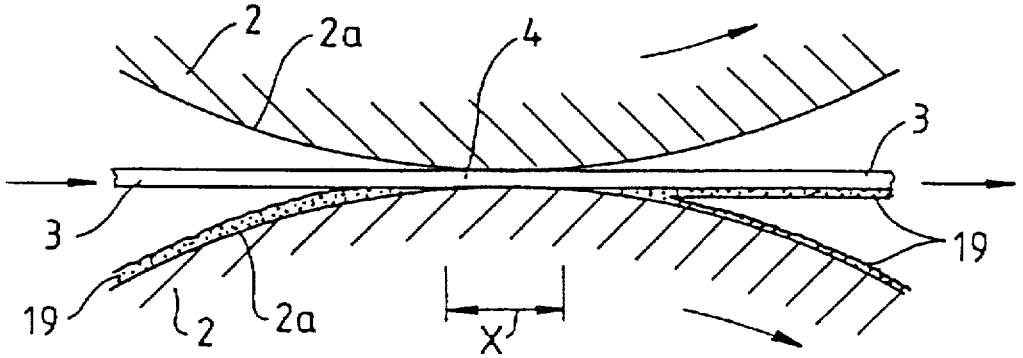

FIG. 14 schematically illustrates how a considerably longer nip 4 in which the liquid or pasty medium 19 to be applied is transferred onto a web 3, can be realized in comparison to a known prior art apparatus illustrated in FIG. 15. The length of the nip 4 is respectively designated x. As can be seen in FIG. 14, the contour of the sliding surface 6 of the pressing shoe is adapted to the contour of the opposing roll 2, plus the thickness of the belt 1 and of the web 3, by an appropriately concave curvature, and the passing endless belt 1, which is pressed by the pressing shoe 5 against the opposing roll 2, follows the contour of the sliding surface 6 in this region. Therefore, a pressing force is transferred to the web 3 along the entire length of the path of the sliding surface 6 and the applied medium 19 can be sufficiently dewatered in the comparatively long nip 4 by the penetration of the liquid portion into the material web, whereby the applied medium is immobilized. As a result, a large layer thickness of solid particles such as color pigments in the liquid or pasty medium 19, can be applied onto the web 3 without so-called "film splitting" occurring when the web leaves the nip as a consequence of insufficient de-watering of the medium in the nip.

As illustrated in FIG. 15, in known apparatus upon application of a relatively thick layer of the liquid or pasty medium 19 after the passage through the nip 4, separation of the film applied onto the material 5 web 3 occurs because this film cannot be sufficiently dewatered nor, as a consequence, sufficiently immobilized in the comparatively short nip. Therefore, upon discharge of the web from the nip 4, a still inefficiently dewatered layer of the film 19 applied onto the material web is pulled off again from the material web and remains on the surface of the opposing roll 2. (Compare the right-hand half of the illustration in FIG. 15).

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. Apparatus for applying a liquid or pasty medium onto a moving material web including that of paper or board, the apparatus comprising:

a flexible endless loop belt having an inner surface within the loop of the belt and having an opposite outer surface; means for moving the belt lengthwise;

a pressing shoe within the loop of the belt, the pressing shoe having a sliding surface positioned in contact with the inner surface of the belt;

an opposing roll rotatable in the opposite direction to the endless belt and having a cylindrical outer surface; the shoe, the belt and the opposing roll being so placed that the outer surface of the roll forms a nip with the outer surface of the endless belt 1n the region of the sliding surface of the pressing shoe, so that the web is guided through the nip between the outer surface of the belt and the outer surface of the roll;

the sliding surface of the shoe being concavely curved in its cross sections extending perpendicular to the axis of the opposing roll with a contour generally adapted to the outer contour of the opposing roll to extend the length of the nip through which the web passes; the shoe being operable for pressing the sliding surface in the direction toward the opposing roll; and a medium applicator for applying liquid or pasty medium onto at least one of the outer surface of the endless belt and the outer surface of the opposing roll at a position thereon for being carried into the nip for being applied to the surface of the web facing the respective one of the endless belt and the opposing roll to which the medium is applied.

2. The apparatus of claim 1, wherein the radius of curvature of the concave surface of the pressing shoe is at least the same size as the radius of curvature of the opposing roll plus the thickness of the endless belt.

3. The apparatus of claim 1, wherein the sliding surface is so shaped and the shoe is so placed that the distance between the sliding surface of the pressing shoe and the outer surface of the opposing roll remain substantially constant along the length of the path of the web through the nip.

4. The apparatus of claim 1, wherein the sliding surface of the shoe is so shaped and the pressing shoe is so oriented that the distance between the sliding surface and the outer surface of the opposing roll is such that the sliding surface approaches the outer surface of the opposing roll along the length of the path of the web through the nip.

5. The apparatus of claim 4, wherein the radius of curvature of the concave sliding surface decreases along the length of the nip and the path of the web.

6. The apparatus of claim 1, wherein the sliding surface has an inlet end where the web enters the nip, and the inlet end of the sliding surface is convexly rounded until it enters the concavely curved sliding surface.

7. The apparatus of claim 6, wherein the sliding surface has an outlet end where the web exits the nip, and the outlet end of the sliding surface is convexly rounded after exiting the concavely curved sliding surface.

8. The apparatus of claim 1, wherein the sliding surface has an outlet end where the web exits the nip, and the outlet end of the sliding surface is convexly rounded after exiting the concavely curved sliding surface.

9. The apparatus of claim 1, further comprising guide means for the belt placed such that upon the belt exiting the outlet end of the sliding surface of the pressing shoe, the belt is oriented away from the web at a first angle $\alpha_1$ with respect to the direction of movement of the web at the exit from the outlet end of the sliding surface, and the web is guided away from the outlet end at a second angle $\alpha_2$ with respect to the tangent at the surface of the opposing roll, wherein for the angles, $|\alpha_1-\alpha_2| \leqq 0.3\ (\alpha_1+\alpha_2)$.

10. The apparatus of claim 9, wherein the first and second angles are the same.

11. The apparatus of claim 1, further comprising a fixed support for the pressing shoe such that the shoe is displaceable toward the opposing roll with respect to the support.

12. The apparatus of claim 11, further comprising hydraulic or pneumatic pressing means on the support for pressing the pressing shoe.

13. The apparatus of claim 1, wherein across the width of the web, the pressing shoe includes pressing means which are adjustable in their pressing force at zones along the shoe.

14. The apparatus of claim 1, further comprising a second fixed supporting shoe also disposed within the loop of the belt and including a second supporting surface Spaced away from the first supporting surface and for supporting the belt passing over the second supporting surface.

15. The apparatus of claim 1, further comprising a drive roll for frictionally engaging one of the inner and outer surfaces of the belt for driving the belt to move.

16. The apparatus of claim 1, further comprising an inner endless belt inside the endless belt, and the inner endless belt being rotatable along with the endless belt together between the supporting surface of the shoe and the opposing roll such that the inner belt is guided in contact with the inner surface of the endless belt and with the sliding surface of the pressing shoe.

17. The apparatus of claim 1, wherein the medium application for applying liquid or pasty medium comprises a doctor application unit and further includes a supply for the pasty medium selected from the group consisting of a pressure chamber, an application sump having a free liquid surface, free jet nozzles application units, through run trough application units, twin roll predosing systems with formation of a sump, application rolls with spray application means and through run troughs and direct application sump systems.

18. Apparatus for applying a liquid or pasty medium onto a moving material web including that of paper or board, the apparatus comprising:

a first flexible endless loop belt having a first inner surface within the loop and an opposite outer surface; means for moving the first belt lengthwise;

a first pressing shoe within the loop of the first belt, the first pressing shoe having a first sliding surface positioned such that the first inner surface of the first belt passes over the first sliding surface;

a second flexible endless loop belt, means for moving the second belt lengthwise in the opposite direction to movement of the first endless belt;

a second pressing shoe within the loop of the second belt, the second pressing shoe having a second sliding surface positioned such that the second inner surface of the second belt passes over the second sliding surface;

the second sliding surface of the second pressing shoe lying opposite the first sliding surface of the first pressing shoe such that the first and second sliding surfaces may be pressed toward one another by the respective first and second pressing shoes;

the first and second flexible belts and the first and second shoes being so placed that the outer surfaces of both of the first and second endless belts form a nip between them in the region of both sliding surfaces of the pressing shoes, through which nip the web is guided;

the sliding surfaces being adapted to one another in their contours to form an extended length nip between the flexible belts along the direction of movement of the web through the nip;

a medium applicator for applying liquid or pasty medium onto the outer surface of at least one of the endless belts for the endless belt to which the medium is applied to carry the medium into the nip for application to the surface of the web facing the belt to which the medium is applied.

19. The apparatus of claim 18, wherein the contours of the respective sliding surfaces of the first and second pressing shoes are flat and generally planar.

20. The apparatus of claim 18, wherein one of the first and second sliding surfaces is concave in its cross section through the axes around which the belts move and the other of the first and second sliding surfaces is convex in its cross section and the contours of the sliding surfaces are adapted to each other so as to define a long nip between the belts through which the web passes.

21. The apparatus of claim 18, wherein the sliding surfaces have such contours that the distance between the two sliding surfaces remains substantially constant along the length of the nip.

22. The apparatus of claim 18, wherein the sliding surfaces have such contours that the distance between the two sliding surfaces decreases along the length of the nip in the direction of passage of the web through the nip.

23. The apparatus of claim 18, wherein each of the first and second sliding surfaces has an inlet end where the web enters the nip and the inlet end of each sliding surface is convexly rounded.

24. The apparatus of claim 23, wherein each of the first and second sliding surfaces has an outlet end where the web exits the nip, and the outlet end of each sliding surface is convexly rounded.

25. The apparatus of claim 18, wherein each of the first and second sliding surfaces has an outlet end where the web exits the nip, and the outlet end of each sliding surface is convexly rounded.

26. The apparatus of claim 18, further comprising a respective fixed support for each pressing shoe such that each shoe is displaceable toward the other shoe and with respect to the support.

27. The apparatus of claim 26, further comprising respective hydraulic or pneumatic pressing means on each support for pressing the pressing shoes toward one another.

28. The apparatus of claim 18, wherein across the width of the web, the pressing shoe includes pressing means which are adjustable in their pressing force at zones along the shoe.

29. The apparatus of claim 18, further comprising a respective third fixed supporting shoe also disposed within the loop of each belt and each including a respective supporting surface spaced away from the first supporting surface and for supporting each belt passing over the third supporting surface.

30. The apparatus of claim 18, further comprising a drive roll frictionally engaging one of the inner and outer surfaces of at least one of the endless belts for driving the endless belts to rotate.

31. The apparatus of claim 18, wherein the medium applicator for applying liquid or pasty medium comprises a doctor application unit and further includes a supply for the pasty medium selected from the group consisting of a pressure chamber, an application sump having a free liquid surface, free jet nozzles application units, through run trough application units, twin roll predosing systems with formation of a sump, application rolls with spray application means and through run troughs and direct application sump systems.

* * * * *